US006306022B1

(12) United States Patent
Tung et al.

(10) Patent No.: US 6,306,022 B1
(45) Date of Patent: Oct. 23, 2001

(54) CHEMICAL-MECHANICAL POLISHING DEVICE

(75) Inventors: Joseph Tung, Hsinchu; Ming-Cheng Yang, Taipei; Lung-Hu Lin; Jiun-Fang Wang, both of Hsinchu, all of (TW)

(73) Assignees: Promos Technologies, Inc.; Mosel Vitelic Inc., both of Hsinchu (TW); Infineon Technologies Inc., Munich (DE)

( * ) Notice: Subject to any disclaimer, the term of this patent is extended or adjusted under 35 U.S.C. 154(b) by 0 days.

(21) Appl. No.: 09/585,564

(22) Filed: Jun. 2, 2000

(51) Int. Cl.[7] ..... B24B 5/00
(52) U.S. Cl. ..... 451/290; 451/443; 451/285
(58) Field of Search ..... 451/56, 443, 450, 451/449, 285, 287, 290

(56) References Cited

U.S. PATENT DOCUMENTS 5,456,627 * 10/1995 Jackson et al. ..... 451/56
5,486,131 * 1/1996 Cesna et al. ..... 451/443
5,626,509 * 5/1997 Hayashi ..... 451/56
5,683,289 * 11/1997 Hempel, Jr. ..... 451/56
5,913,715 * 6/1999 Kirchner et al. ..... 451/443

* cited by examiner

*Primary Examiner*—Eileen P. Morgan
(74) *Attorney, Agent, or Firm*—Jiawei Huang; J. C. Patents

(57) ABSTRACT

A device for chemical-mechanical polishing. The device can be applied to a chemical polishing table spinning in a fixed direction and a polishing pad above of it. A chemical-mechanical polishing device according to the present invention is at least comprised of a main body of conditioner with a plurality of mounting pads, wherein each mounting pad is mounted with the diamond granules and located on the lower surface of conditioner, distributed on the rim of main body of each mounting pad. It can contact with polishing pads when cleaning the polishing pads and a number of cavities are across the upper and lower surfaces of each main body of conditioner and distributed between each mounting pads as well. When using the conditioners to clean out the polishing pads, the de-ionized water will flow through the cavities to wash off the acid or basic slurry to eliminate the destruction made by the solders around the diamond granules to extend the durability of the conditioner.

9 Claims, 4 Drawing Sheets

CHEMICAL-MECHANICAL POLISHING DEVICE

BACKGROUND OF THE INVENTION

1. Field of Invention

The present invention relates to a chemical-mechanical polishing (CMP) device. More particularly, the present invention relates to a chemical-mechanical polishing device with a porous dispensing tube.

2. Description of Related Art

In the manufacturing techniques of semiconductor devices, planarization surface is an important step in performing a high-density photolithography process. The planarized surface with little variation in height is easy to avoid the exposure diffusion and to achieve the precise pattern transfer. There are two major planarization techniques, Spin-On-Glass (SOG) and Chemical-Mechanical Polishing (CMP), however, in the sub-half-micron device era, the Spin-On-Glass method is incapable of providing required planarization and the Chemical-Mechanical Polishing method becomes the unique technique to provide global planarization on the manufacturing process of Very-Large Scale Integration; VLSI or even the Ultra-Large Scale Integration; ULSI circuitry.

FIGS. 1A and 1B are a top view and a side view showing a conventional chemical-mechanical polishing device, respectively. As shown in FIGS. 1A and 1B, the device includes a polishing table 10, a wafer holder 11 for wafer grabbing, a wafer 12, a polishing pad 13 over the polishing table 10, a tube 14 for carrying slurry 15 to the polishing pad 13, a liquid pump 16 for pumping slurry 15 to the tube 14, and a conditioner 17 for dressing the surface of the polishing pad 13. When the chemical-mechanical polishing device is running, the polishing table 10 and the wafer holder 11 spin independently along a certain directions, as depicted as the reference numbers 18*a* and 18*b*. The wafer holder 11 grabbing the back side 19 of the wafer 12, presses the front side 20 of the wafer 12 against onto the surface of the polishing pad 13. The liquid pump 16 also works continuously to pump slurry 15 to the polishing pad 13 through the tube 14. Therefore, the process of the chemical-mechanical polishing can rely on chemical reagents and abrasive particles suspended in the slurry 15. The reagents react chemically with molecules on the front side 20 of the wafer 12 to form an easy-grind layer, while the abrasive particles of the slurry 15 help to remove the protrusion within the easy-grind layer. Via the continuous chemical reaction and repeated mechanical abrasion, a surface of high planarity is ultimately formed over the front side 20 of the wafer 12. Basically, chemical-mechanical polishing is a technique of planarization, using the theory of mechanical polishing coupled with proper chemical reagents and abrasive particles to take off the fluctuated outline on the surface.

Polishing pad is a porous material, the cavities inside of the polishing pad could be stocked by the stuff used in the polishing process (such as abrasive particles of the slurry or something left during the process of wafer polishing) after using the polishing pad for a while, the performance of polishing may go down based on the changes of the characteristics of polishing materials. After a number of times of wafers polishing, the conditioner 17 would clean out the surface of polishing pad till the surface with cavities shows up. The polishing pad would not be renewed until the polishing pad could not be used anymore.

FIG. 2 is the bottom view of the conditioner, where on the rim of the main body 22 of conditioner 20 have a mounting pad 24 and each, is mounted with a plurality of diamond granules. The conditioners 20 use these diamond granules mounted on the polishing pad 24 to work when the chemical-mechanical polishing device is activated. However, these diamond granules could be nickel or the other kind of metal soldered on the mounting pad 24 of the conditioner 22. While the chemical-mechanical polishing device is running, any kind of acid or basic slurry (especially for those acid slurry used in metal polishing) may erode those solders between the diamond granules and mounting pads 24 to get separated off from the mounting pads 24 and to shorten the life of conditioner 22; also, those diamond granules left on the polishing pad may scratch the wafers in the process of polishing or later on to cause the destruction of devices.

SUMMARY OF INVENTION

Accordingly, the present invention provides a device for chemical-mechanical polishing which can be applied to the CMP machine. The CMP machine includes a chemical polishing table, which can be spinned in a fixed direction and has a polishing pad. A chemical-mechanical polishing device according to the present invention is at least comprised of a main body of conditioner with a plurality of mounting pads, wherein each mounting pad is mounted with the diamond granules and located on the lower surface of the conditioner, distributed on the rim of main body of each mounting pad. It can contact with polishing pads when cleaning the polishing pads and a number of cavities penetrate through the upper and lower surfaces of each main body of the conditioner and distributed between each mounting pads as well. When using the conditioners to clean out the polishing pads, the de-ionized water will flow through the cavities to wash off the acid or basic slurry to lower the rate of destruction made by the solders around the diamond granules to extend the durability of the conditioner.

In addition, the first type circular trench on the upper surface of conditioner is located inside the cavities, and more second type trenches are connected with the first type trench and cavities in vertical position. In order to move off the slurry, the second type of trenches transfuse the de-ionized water into the first type trench, and the water can evenly flow to the diamond granules on the polishing pads along the cavities to the next trenches.

The present invention will be better understood from the following detailed description of an exemplary embodiment thereof taken in conjunction with the appended drawings.

SUMMARY OF INVBRIEF DESCRIPTION OF THE DRAWINGS

The accompanying drawings are to provide a further understanding of the present invention. The drawings illustrate embodiments of the invention and, together with the description, serve to explain the principles of the invention. In the drawings, FIG. 1A shows the top view of a conventional CMP device;

DESCRIPTION OF THE PREFERRED EMBODIMENTS

Figure 1A:
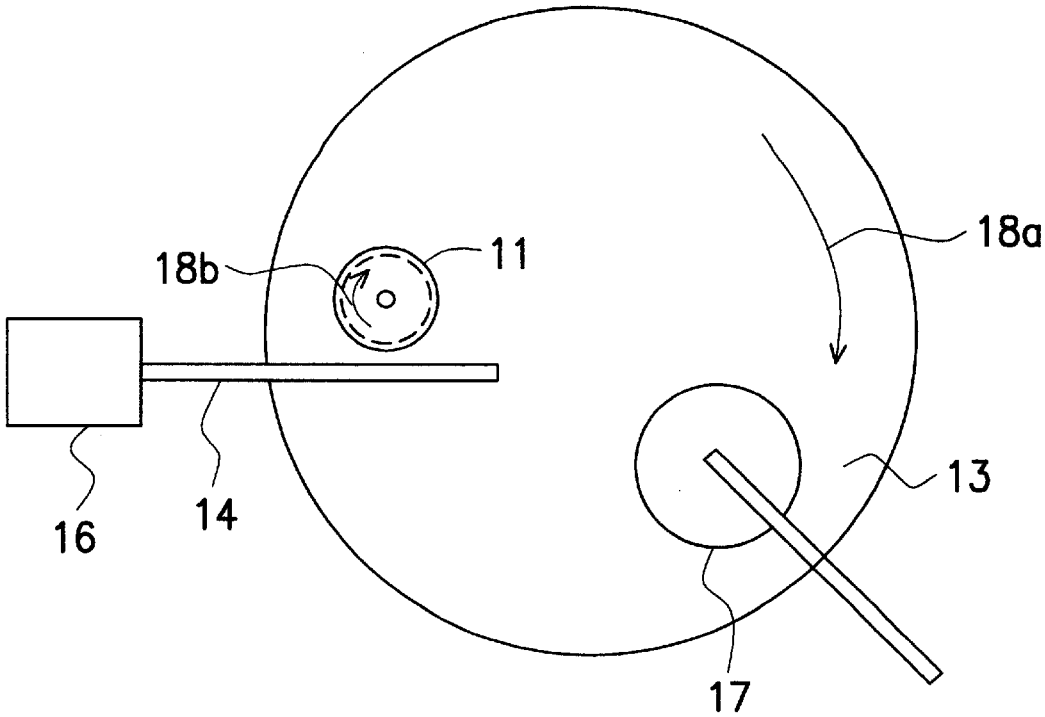
FIG. 1A (PRIOR ART)
FIG. 1B shows the side view of a conventional chemical-mechanical device.
Figure 1B:
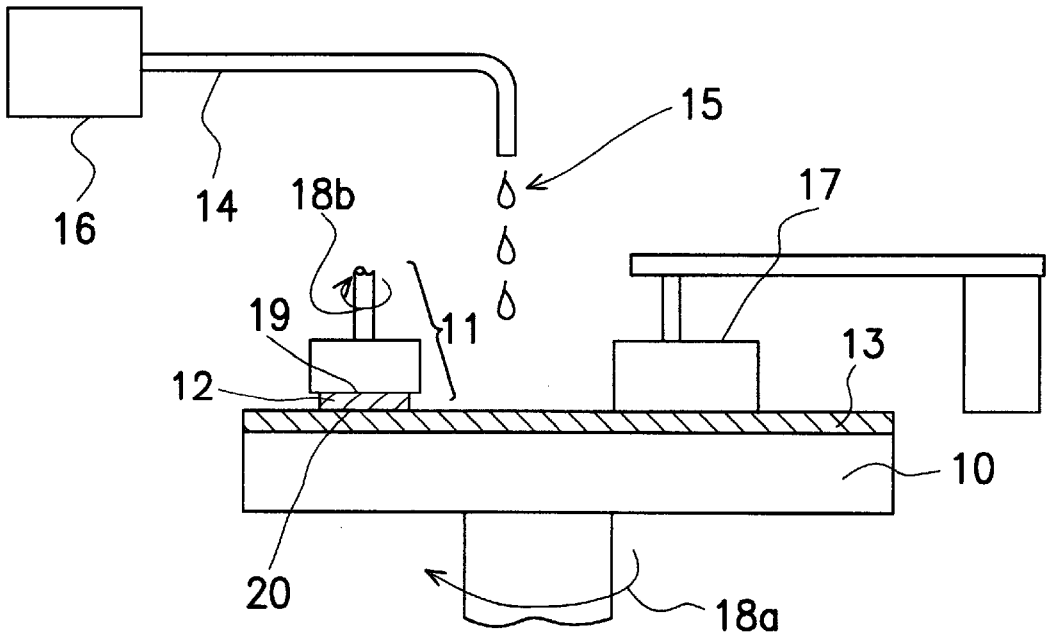
FIG. 1B (PRIOR ART)
Figure 2:
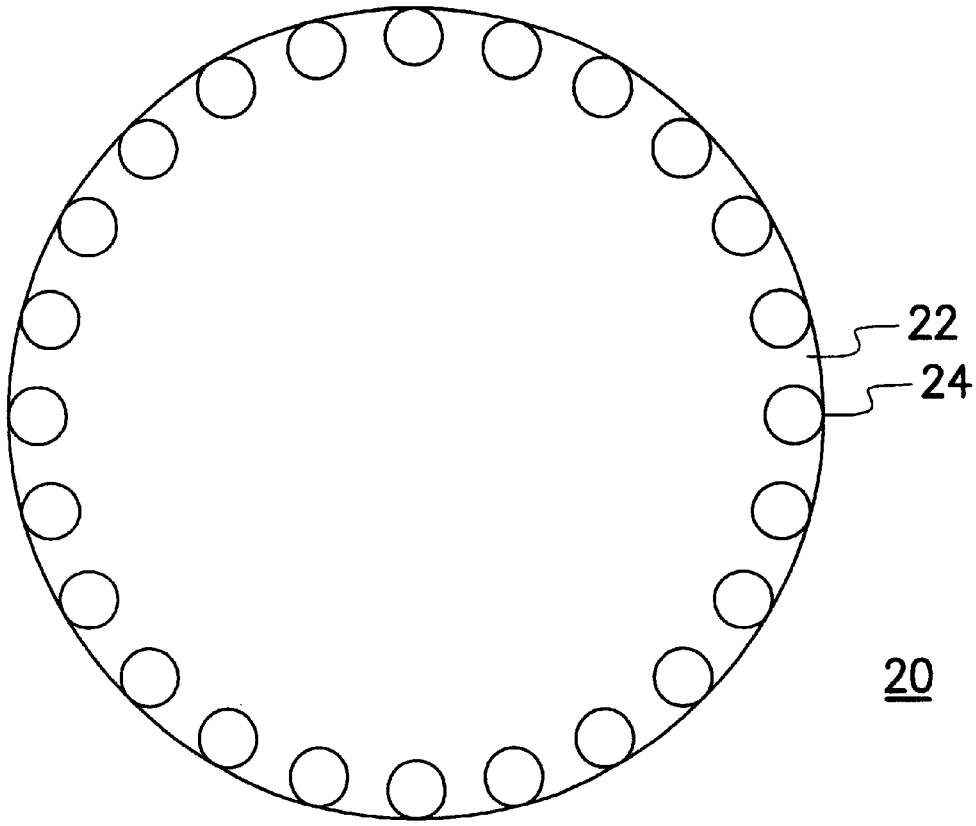
FIG. 2 (PRIOR ART)
FIG. 2 shows the bottom view of the conventional conditioner of the CMP device as shown in FIG. 1A.
Figure 3A:
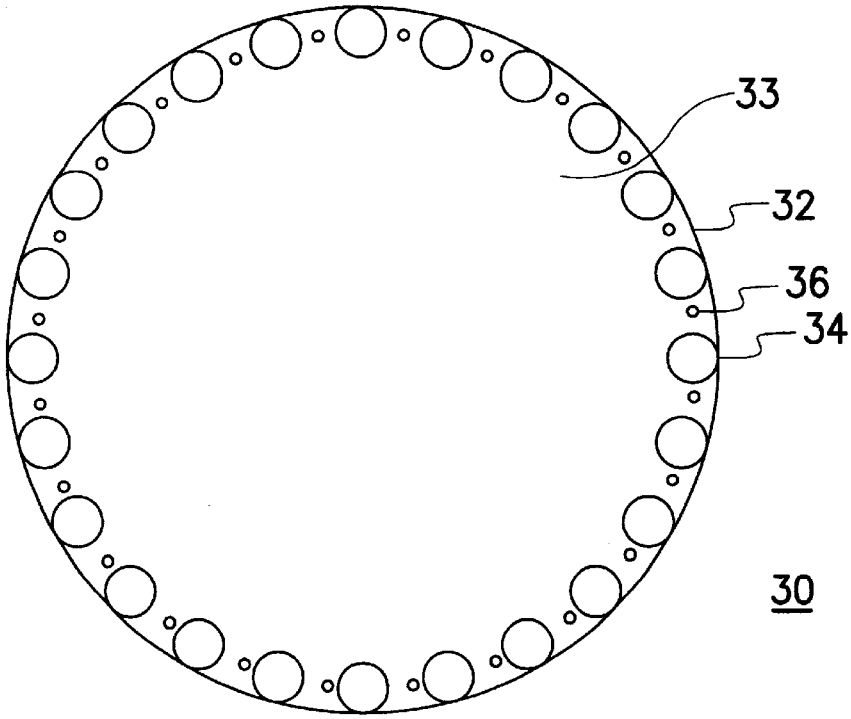
FIG. 3A shows the bottom view of a conditioner in accordance with one preferred embodiment of the present invention.

FIG. 3A shows a bottom view of a conditioner in accordance with one preferred embodiment of the present invention.

Refer to FIG. 3A, which shows a lower surface 33 of a conditioner 30 used in the chemical-mechanical polishing device. The main body 32 of the conditioner 30 includes a plurality of mounting pads 34. Each of the mounting pads 34 is mounted with diamond granules. These mounting pads 34 are mounted on the lower surface 33 of the main body 32 of the conditioner 30 which contacts with the polishing pads and evenly distributed on the rim of the conditioner 30, where there are cavities 36 contained in the conditioner 30, vertically across the upper surface 35 and the lower surface 33 of the conditioner 30 where the cavities are allocated in-between the mounting pads 34.

Figure 3B:
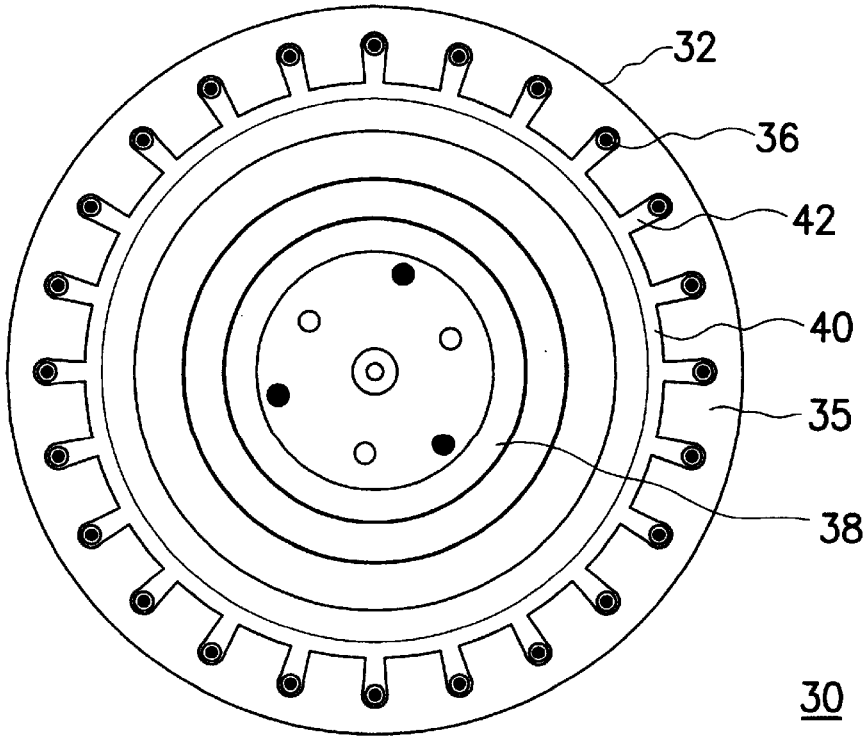
FIG. 3B shows the top view of the conditioner shown in the FIG. 3A.

Refer to FIG. 3B, which shows a top view of the conditioner 30 of the FIG. 3A. The cavities 36 penetrate through the conditioner 32 to connect a upper surface 35 with the lower surface 33 of FIG. 3A. When using the conditioner 30 to clean the polishing pads, the de-ionized water will flow through the cavities 36 to the diamond granules on the mounting pads 34 for diluting or even washing off the acid or basic slurry to eliminate the destruction caused by the solders surrounded with the diamond granules 34 and it would extend the life of conditioner.

In addition, a central part of the conditioner 30 is a fixed part 38 where is to fix the conditioner 30 on the moveable holder. A first type circular trenches 40 on the upper surface 35 of the conditioner 32 is located inside the cavities 36, and second type circular trenches 42 contacted with the first type trench 40 and cavities 36 are located between the cavities 36 and the first type trench 40. In order to clean the polishing pad, de-ionized water is transfused into the first type trench 40 and flows along the second type trench 42 to the mounting pads 34 and the cavities 36 for diluting or even removing the acid or basic slurry.

Figure 4:
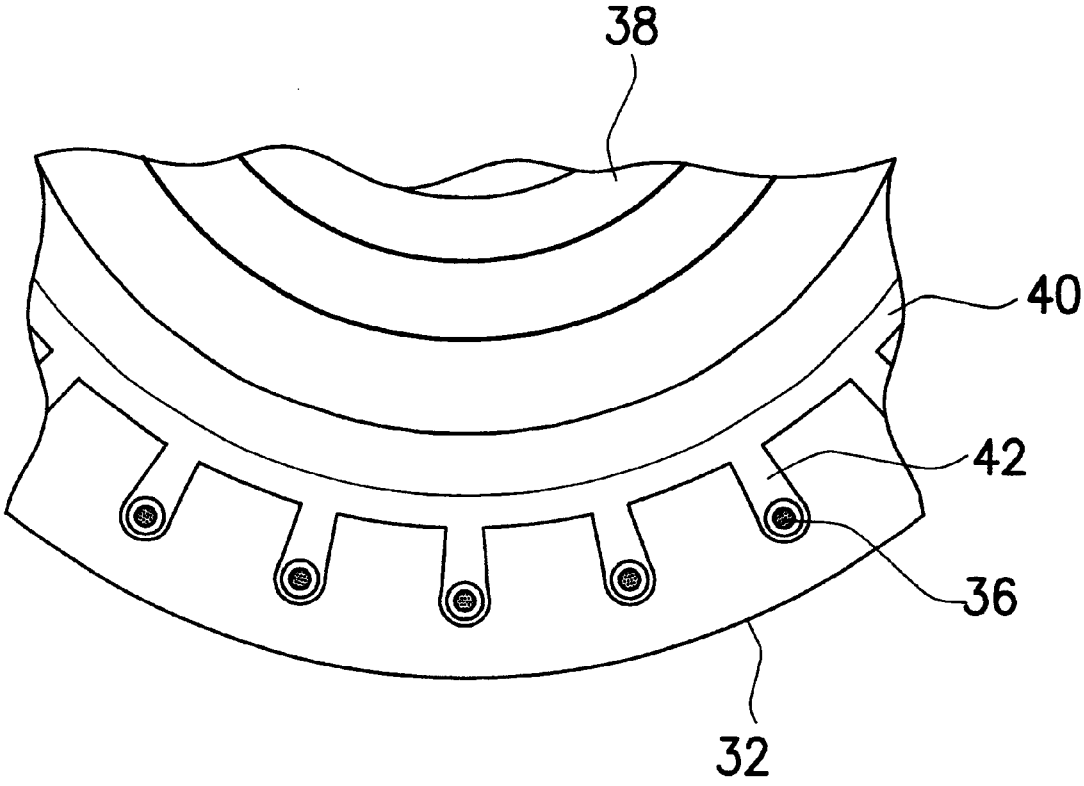
FIG. 4 shows the scaling view of the conditioner as shown in the FIG. 3B.

FIG. 4 shows the scaling view of the FIG. 3B. It can be understood the relation between the first type trench 40, the second type trench 42 and the cavities 36 via the more detailed drawings. The reference numbers are still followed by those used in the FIGS. 3A and 3B.

The present invention uses the upper surface of the conditioner to make trenches, which can guide the de-ionized water to the cavities and through the lower surface of the conditioner to distribute evenly between the diamond granules. Since the slurry may get stocked inside the cavities on polishing pad when activates the chemical-mechanical polishing device. The conditioner may contact with the acid slurry to cause erosion on the metallic solders surrounding the diamond granules when cleaning the polishing pad. Particularly when metal polishing, it would be much easier to cause the diamond granules removed off from the polishing pad since the acid slurry could easily erode the metallic solders and wafers. The de-ionized water flows evenly around the diamond granules via the use of the trenches and the cavities according to the present invention which is to lower down the chance happened for high density slurry left inside the polishing pad and to prevent the separation of the diamond granules fixed on the conditioner in order to extend the life of conditioner. The device provided by the present invention can guide the de-ionized water to the space inside the diamond granules to extend the life of conditioner, therefore, the cost on the conditioner could go down in large scale. In addition, the device according to the present invention can also lower down the falling chance of the diamond granules, so as to reduce the quantity of damaged wafers. With this, it would be a great help to the yield rate on manufacturing process and the reduction on the destruction of wafers can also have the same efficiency of low cost.

The present invention has been described using an exemplary preferred embodiment. However, it is to be understood that the scope and the sprit of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A chemical-mechanical polishing (CMP) device which is applicable to a process of chemical-mechanical polishing, wherein the device is located on a CMP machine, wherein the polishing machine comprises a polishing table spinning in a fixed direction, wherein the polishing table includes a polishing pad, wherein the CMP device comprised of:

a conditioner, wherein the conditioner comprises a lower surface and an upper surface, wherein the lower surface faces the polishing pad, wherein a plurality of cavities are distributed on the conditioner, wherein the cavities penetrate through the conditioner and connect the upper surface with the lower surface, wherein the upper surface of the conditioner comprises a plurality of first circular trenches and a plurality of second trenches, and the second trenches is positioned between the cavities and the first circular trenches; and a plurality of diamond granules, mounted on an outer rim of the lower surface of the conditioner, wherein de-ionized water flows from the upper surface of the conditioner through the cavities to the lower surface of the conditioner, and then flows between the diamond granules on the lower surface of the conditioner.

2. A chemical-mechanical polishing device as described in the claim 1, the cavities are distributed between the diamond granules.

3. A chemical-mechanical polishing device as described in the claim 1, wherein the chemical mechanical polishing device uses an acid slurry.

4. A chemical-mechanical polishing device comprising:

a conditioner, wherein the conditioner comprises a lower surface and an upper surface which are parallel to each other, and further comprises a plurality of cavities distributed throughout the conditioner, wherein the cavities penetrate through the conditioner and connect the upper surface with the lower surface, wherein the upper surface has a plurality of first circular trenches and a plurality of second trenches distributed between the cavities and the first type trenches; and a plurality of diamond granules, mounted on the outer rim of the lower surface on the conditioner, wherein de-ionized water transfused into the first trenches flows along the second trenches and the cavities to a space around the diamond granules.

5. A chemical-mechanical polishing device as described in the claim 4, the cavities are distributed among the diamond granules.

6. A chemical-mechanical polishing device as described in the claim 4, wherein the chemical mechanical polishing device is used for a metal CMP process.

7. A chemical-mechanical polishing device as described in the claim 6, wherein the chemical mechanical polishing device uses an acid slurry.

8. A chemical-mechanical polishing (CMP) device, comprising:

a polishing table spinning in a fixed direction during a CMP process is performed, wherein the polishing table includes a polishing pad;

a conditioner, wherein the conditioner comprises:

a lower surface facing the polishing pad, wherein a plurality of diamond granules are mounted on a rim of the lower surface and a plurality of cavities are located between the diamond granules at the rim of the lower surface; and an upper surface coupled with a moveable holder and having a plurality of first circular trenches located thereon, wherein the cavities on the lower surface of the conditioner penetrate through the conditioner to connect the upper surface with the lower surface.

9. The chemical-mechanical polishing device of claim 8, further comprises a plurality of second trenches located on the upper surface, wherein the second trenches are located between the cavities and the first circular trenches and de-ionized water flows through the first trenches, the second trenches and the cavities to the lower surface of the conditioner during the condition process is performed.

* * * * *